US005144111A

United States Patent [19]

Von Gaisberg et al.

[11] Patent Number: 5,144,111

[45] Date of Patent: Sep. 1, 1992

[54] ELECTRIC CIGAR LIGHTER WITH BIMETALLIC SNAP ACTIVE TEMPERATURE CONTROLLED SWITCHING OFF

[75] Inventors: Alexander Von Gaisberg, Beilstein; Klaus-Philipp Merz, Karlsruhe, both of Fed. Rep. of Germany

[73] Assignee: Schoeller & Co. Elektrotechnische Fabrik GmbH & Co., Frankfurt, Fed. Rep. of Germany

[21] Appl. No.: 588,861

[22] Filed: Sep. 27, 1990

[30] Foreign Application Priority Data

Sep. 29, 1989 [DE] Fed. Rep. of Germany ..... 3932603

[51] Int. Cl.[5] ..... F23Q 7/22; H05B 1/02

[52] U.S. Cl. ..... 219/265; 219/269; 361/264

[58] Field of Search ..... 219/260-270; 361/264-266

[56] References Cited

U.S. PATENT DOCUMENTS

| | | | |
|---|---|---|---|
| 2,129,374 | 9/1938 | Johnson . | |
| 2,220,607 | 11/1940 | Mayo | 219/269 X |
| 2,220,625 | 11/1940 | Sinku | 219/265 |
| 2,220,978 | 11/1940 | Shakespeare | 219/265 |
| 2,292,408 | 8/1942 | Spencer | 219/269 X |
| 2,459,650 | 1/1949 | Johnson | 219/264 |

FOREIGN PATENT DOCUMENTS 2918404 11/1980 Fed. Rep. of Germany .

*Primary Examiner*—Anthony Bartis

*Attorney, Agent, or Firm*—Nikaido, Marmelstein, Murray & Oram

[57] ABSTRACT

An electric cigar lighter for installation in a dashboard of a motor vehicle, has an electrically conductive lighter plug containing an electrically conductive glow coil dish with a glow coil having one end electrically connected to the glow coil dish and another end connected to the lighter plug. A socket having a plug-in contact electrically connected to a negative-pole terminal establishes electrical connection with the lighter plug when the lighter plug is inserted therein. A switch associated with the lighter plug includes a fixed non-flexible contact element secured in the bottom of the socket in electrically insulated relationship thereto and electrically connected to a positive-pole terminal and the glow coil dish which is mounted at the end of the lighter plug and arranged for movement relative thereto into and out of electrical contact with the contact element. A bimetallic snap-action disc disposed in the lighter plug in heat exchange relationship with the glow coil is arranged to move the glow coil dish out of electrical contact with the switch contact element upon attainment of a predetermined temperature. A push-button is provided in the lighter plug for resetting the bimetallic snap-action disc and moving the glow coil dish into contact with the contact element to initiate operation of the lighter.

4 Claims, 1 Drawing Sheet

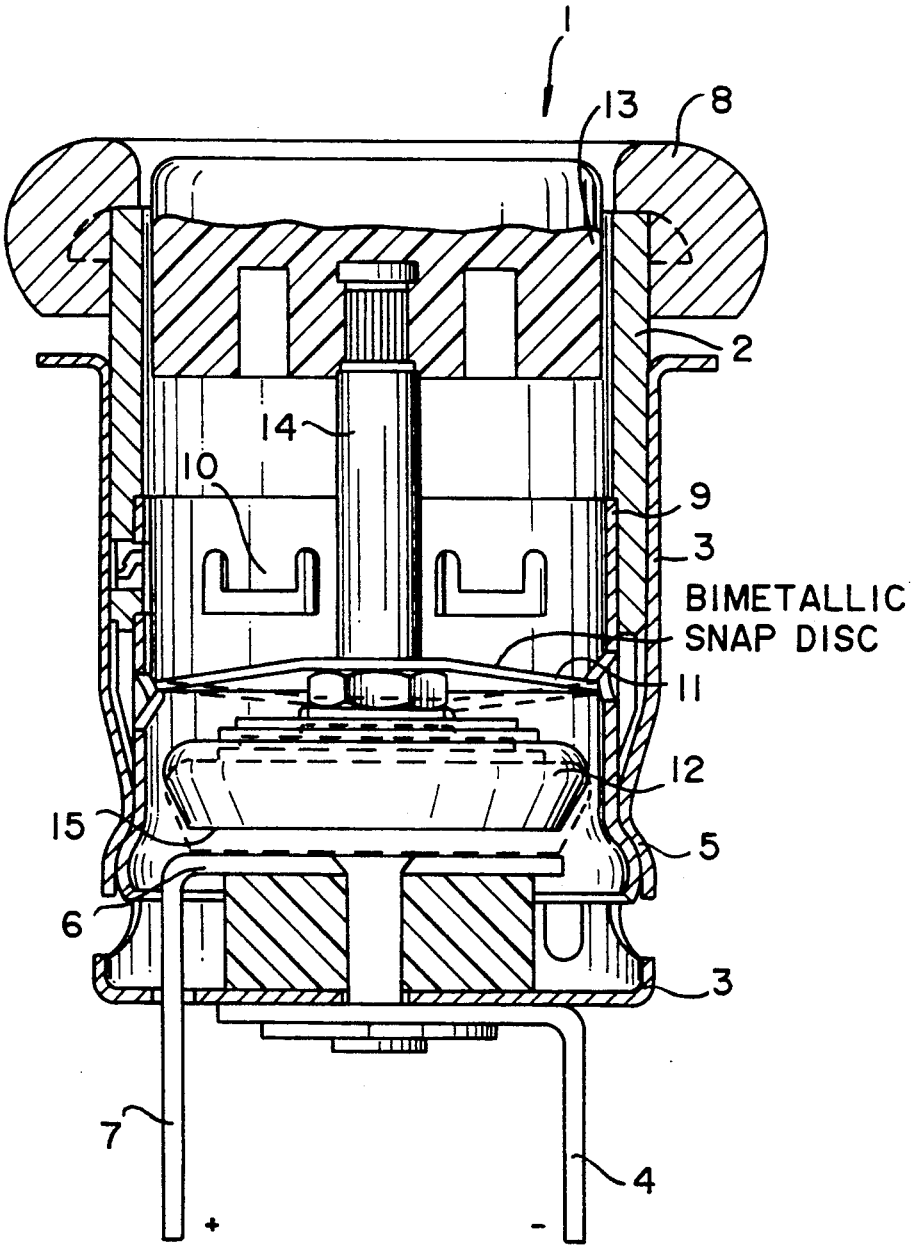
1
13
8
2
14
10
9
3
BIMETALLIC
SNAP DISC
11
12
15
5
6
3
7
4
+
-

ELECTRIC CIGAR LIGHTER WITH BIMETALLIC SNAP ACTIVE TEMPERATURE CONTROLLED SWITCHING OFF

BACKGROUND OF THE INVENTION

The invention relates to an electric lighter for lighting cigars or cigarettes, the lighter including a lighter Plug and a socket, and having a switch contact for connecting the lighter plugs to a terminal, and a means for temperature controlled opening of the switch contact.

Such a cigar lighter is known from U.S. Pat. No. 2,637,799. In this patent, a frequently employed cigar lighter for motor vehicles is described as prior art. Such a cigar lighter comprises a socket which is arranged in the dashboard of a motor vehicle and into which is inserted a lighter plug which contains a glow coil, as well as a negative pole which in vehicles is connected to a ground, the negative pole being connected to the lighter plug via a plug-in contact. When the lighter is to be heated, a connection to a positive pole is established via a movable part in the lighter plug, with the result that a current flows in the glow coil. The glow coil heats a bimetal spring which is arranged in the socket and releases the movable part of the lighter plug for the purpose of resetting it to a rest position and thereby switching off the current circuit when the lighter has heated up. Resetting is effected by a spring which was pre-tensioned when the current circuit was previously closed.

In the aforementioned patent, a design of a cigar lighter is taught which has fewer components as compared with previous lighters. In this design, illustrated in the drawings of U.S. Pat. No. 2,637,799 described above, the function of a resetting spring and of a trigger function of a bimetal spring are combined in one component, namely a bimetallic snap-action disc. However, this cigar lighter still has a relatively large number of components and requires a relatively high expenditure on production thereof. Further, the overall length of the lighter is relatively great. This results because a switch contact for the positive pole and a plug-in contact for the positive pole are arranged one behind the other. It is furthermore disadvantageous that the glow coil is a relatively long way away from the bimetallic snap-action disc, with the result that switching off does not occur exactly at a particular temperature but is dependent, for example, also on the ambient temperature.

In the aforementioned patent, the plug-in contact for the positive pole is formed by a glow-coil dish of the lighter plug and bimetal springs which are arranged in a bottom zone of the socket. This means that, each time the lighter plug is used, the glow-coil dish rubs against the contact springs of the socket and, as a result, is subject to wear. It is furthermore disadvantageous that the contact springs must be matched to the shape of the glow-coil dish. This is disadvantageous particularly because the socket of the cigar lighter is frequently used in vehicles for connecting accessory devices such as, for example, a lamp or a tool. The connection of accessory devices is effected via an accessory plug, the shape of which is approximately that of a lighter plug. There is the risk that, with accessory plugs, the contact springs in the socket will be bent. The same problem exists in the known design, described first in the above, having a bimetal spring. In addition, in both of the above-discussed types of design the contact springs of the positive pole are matched to the shape of the glow-coil dish, with the result that only small contacts are available. The conductor cross-sections and contact resistances at the points of contact which result from this construction limits the permissible current which can be drawn from the socket.

SUMMARY OF THE INVENTION

An object of the invention is to provide an electric lighter which avoids the aforesaid disadvantages of known electric lighters.

This object is achieved by an electric lighter having a lighter plug which contains a glow-coil dish and glow coil. The electric lighter also includes a socket into which the lighter plug is inserted, a switch contact and means for the temperature-controlled opening of the switch contact. The switch contact is a nonflexible contact piece, and wherein the means for temperature-controlled opening is disposed within the lighter plug in the immediate vicinity of the glow-coil dish.

The cigar lighter according to the invention contains a relatively small number of components, is relatively simple to produce, and has a relatively small overall length. There is no plug-in contact for a positive pole, only a switch contact. A fixed contact part in the socket of the lighter can have a relatively large area, i.e., the fixed contact part can carry large currents, and no special adaptation to the shape of the glow-coil dish is required. The means for temperature-controlled opening are arranged directly adjacent to the glow-coil dish, with the result that good thermal coupling is ensured.

The use of a bimetallic snap-action disc for the temperature-controlled switching off is particularly advantageous because, in addition, it fulfills the required spring function. Depending on the design of the lighter plug, other means for the temperature-controlled opening of the switch contact may also be used, such as, for example, a conventional bimetal yoke, a combination of a metal piece and a permanent magnet, and a memory-metal switching element. However, a spring, generally a compression spring, must additionally be provided in these cases.

BRIEF DESCRIPTION OF THE DRAWING

A more detailed description of an electric lighter according to the invention is given with reference to an illustrative embodiment represented in the sole figure of drawing.

DETAILED DESCRIPTION OF THE PREFERRED EMBODIMENT

The drawing shows an electric lighter 1, for lighting cigars or cigarettes, which comprises a lighter plug 2 and a cup-shaped socket 3. The socket 3 is suitable for installation in a dashboard of a motor vehicle and has a negative-pole terminal 4. The socket 3 furthermore has resilient means 5 which hold an inserted lighter plug 2 or an accessory plug and establishes contact with the negative-pole terminal 4. A disc-shaped positive contact 6, which is a switch contact element connected to a positive-pole terminal 7. The positive contact 6 is arranged in an electrically insulated manner in the plane of the bottom of the cup-shaped socket 3.

The lighter plug 2 has a grip 8 which is made, for example, of plastic, and a metallic cup part 9, which is latched to the grip 8 via bent-up portions 10. Arranged in the cup part 9 is an arched bimetallic snap-action disc 11, which is connected via a pin 14 to a glow-coil dish 12 and an actuating button 13 The glow-coil dish 12 has a glow coil therein (not shown).

If the lighter plug 2 is to be heated up, then, with the aid of the actuating button 13, which slides within the grip 8, the glow-coil dish 12 is pressed with its front edge 15 against the positive-pole contact 6 and held in this position by the spring action of the bimetallic snap-action disc 11, which is now arched towards the other side. A current flows from the positive-pole terminal 7 to the negative-pole terminal 4 via the positive-pole contact 6, the glow-coil dish 12, the bimetallic disc 11, the cup part 9 and the socket 3.

When the glow coil in the glow-coil dish 12 has heated up, the electric bimetallic snap-action disc 11 snaps back into its rest position, which is that position shown in the drawing, thereby causing the glow-coil dish 12 to be moved abruptly, i.e., without producing an arc, by about 2 mm from the positive-pole contact 6. A snapping noise is thereby generated by the bimetallic snap-action disc 11, and the actuating button 13 then assumes its original position. Of course, the electric lighter 1 can furthermore also include an illumination means or various other additional devices, such as, for example, overload protective devices.

While a preferred embodiment has been shown and illustrated, it will be understood that the present invention is not limited thereto, but can be otherwise embodied within the scope of the following claims.

What is claimed is:

1. An electric lighter for installation in a dashboard of a motor vehicle, comprising:

an electrically conductive lighter plug which contains an electrically conductive glow-coil dish with a glow coil, said glow coil having one end electrically connected to said glow coil dish and another end connected to said lighter plug;

a negative-pole terminal and a positive-pole terminal;

an electrically conductive socket which can receive said lighter plug and latch said lighter plug therein, said socking being a plug-in contact electrically connected to said negative-pole terminal, said socket establishing an electrical connection with said light plug when said lighter plug is inserted therein;

a switch contact means associated with said lighter plug and socket for electrically connecting said lighter plug to said positive-pole terminal;

temperature responsive opening means for opening said switch contact means upon heating of said opening means by said glow coil to a predetermined temperature;

said switch contact means comprising a fixed non-flexible switch contact element secured in a plane of a bottom of said socket in electrically insulated relationship thereto and electrically connected to said positive pole terminal and said glow-coil dish which is mounted at the end of said lighter plug and arranged for movement relative thereto into and out of electrical contact with said switch contact element;

said opening means being disposed within said lighter plug adjacent said glow-coil dish and being in heat exchange relation with said glow coil and said opening means being arranged to move said glow-coil dish out of electrical contact with said switch contact element upon attainment of a predetermined temperature.

2. An electric lighter according to claim 1, wherein said opening means comprises a bimetallic snap-action member which is movable between a first position and a second position; said bimetallic snap-action member, upon movement to said first position, moves said glow-coil dish into a switch-off position of said switch contact means and, upon movement to said second position by a force applied to an actuating member in said lighter plug and operatively associated with said bimetallic member, supplies a spring force required for the closure of said switch contact means.

3. An electric lighter according to claim 1, wherein said plug-in contact connected to said negative-pole terminals has a relatively large contact area, and said fixed contact element in said socket has a relatively large contact area, thereby permitting accessory devices having high current consumption to be plugged into said socket instead of said lighter plug.

4. An electric lighter for installation in a dashboard of a motor vehicle, comprising:

an electrically conductive lighter plug which contains an electrically conductive glow-coil dish with a glow coil, said glow coil having one end electrically connected to said glow coil dish and another end electrically connected to said lighter plug;

a negative-pole terminal;

a positive-pole terminal;

a socket means for removably receiving said lighter plug and, in an operating position of said lighter plug, for latching said lighter plug, said socket means being electrically connected to said negative-pole terminal, said socket means establishing an electrical connection with the lighter plug when the lighter plug is inserted therein;

a switch contact means for connecting said lighter plug to said positive-pole terminal, said switch contact means comprising a fixed switch contact element electrically connected to said positive-pole terminal and electrically insulated from said socket means and secured in a bottom portion of said socket means, said glow coil dish being mounted on an end of the lighter plug and being arranged for movement relative to the lighter plug into and out of contact with said switch contact means;

temperature responsive opening means responsive to the temperature of said glow coil, said opening means being mounted for movement with said lighter plug, said temperature responsive opening means being arranged to move the glow coil dish out of electrical contact element with the fixed switch contact upon attainment of a predetermined temperature.

* * * * *

UNITED STATES PATENT AND TRADEMARK OFFICE

CERTIFICATE OF CORRECTION

PATENT NO. : 5,144,111

DATED : September 1, 1992

INVENTOR(S) : Von Gaisberg et al

It is certified that error appears in the above-identified patent and that said Letters Patent is hereby corrected as shown below:

On the title page, item (30):

Please correct the Priority Document No. from "3932603" to

--3932603.9--.

Signed and Sealed this

Twenty-eighth Day of September, 1993

Bruce Lehman

*Attest:*

BRUCE LEHMAN

*Attesting Officer*

*Commissioner of Patents and Trademarks*